US010410477B2

(12) United States Patent
Hoffman et al.

(10) Patent No.: US 10,410,477 B2
(45) Date of Patent: Sep. 10, 2019

(54) EXPANDING HALO REELS GAME

(71) Applicant: URSA MAJOR MEDIA, INC., Reno, NV (US)

(72) Inventors: Benjamin C. Hoffman, Reno, NV (US); William F. Burrows, Reno, NV (US); Jason B. Newmark, Reno, NV (US); Lucas A. Munns, Reno, NV (US); Joseph G. Berger, Reno, NV (US); Farhad Ahmadzai, Reno, NV (US)

(73) Assignee: URSA Major Media, Inc., Reno, NV (US)

( * ) Notice: Subject to any disclaimer, the term of this patent is extended or adjusted under 35 U.S.C. 154(b) by 501 days.

(21) Appl. No.: 14/930,955

(22) Filed: Nov. 3, 2015

(65) Prior Publication Data

US 2016/0125688 A1 May 5, 2016

Related U.S. Application Data

(60) Provisional application No. 62/074,785, filed on Nov. 4, 2014.

(51) Int. Cl.

| | |
|---|---|
| ***G07F 17/00*** | (2006.01) |
| ***G07F 19/00*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/326* (2013.01); *G07F 17/3265* (2013.01)

(58) Field of Classification Search

CPC .... G07F 17/32; G07F 17/326; G07F 17/3262; G07F 17/3265; G07F 17/3267; G07F 17/34

See application file for complete search history.

(56) References Cited

U.S. PATENT DOCUMENTS

| | | | | |
|---|---|---|---|---|
| 6,544,120 | B2 * | 4/2003 | Ainsworth | G07F 17/3244 273/138.2 |
| 7,850,520 | B2 * | 12/2010 | Yoshimi | G07F 17/34 273/143 R |
| 8,795,059 | B2 * | 8/2014 | Aoki | G07F 17/32 463/20 |
| 9,098,847 | B2 * | 8/2015 | Basallo | G07F 17/3267 |
| 9,177,447 | B2 * | 11/2015 | Zoltewicz | G07F 17/326 |
| 2003/0054875 | A1 * | 3/2003 | Marks | G07F 17/32 463/20 |
| 2005/0054436 | A1 * | 3/2005 | Frizzell | G07F 17/3265 463/25 |

(Continued)

*Primary Examiner* — Milap Shah
(74) *Attorney, Agent, or Firm* — Craig H. Macy

(57) ABSTRACT

A method of operating a gaming device to play an expanding halo reels game may include the steps of: Displaying a plurality of reels, each of the reels comprising a plurality of symbols; receiving a wager; spinning the reels; stopping the reels; evaluating the stopped reels for a winning combination of symbols; activating a first halo when there is a winning combination of symbols, the first halo comprising a plurality of symbols that surround at least a portion of the reels; moving the first halo with respect to the reels; stopping the first halo; evaluating the stopped first halo and reels for a winning combination of symbols; and terminating game play when there is no winning combination of symbols.

19 Claims, 13 Drawing Sheets

(56) References Cited

U.S. PATENT DOCUMENTS

2006/0030387 A1* 2/2006 Jackson ..... G07F 17/3211 463/16
2006/0084498 A1* 4/2006 Baerlocher ..... G07F 17/3213 463/20
2007/0087805 A1* 4/2007 Taylor ..... G07F 17/32 463/16
2007/0178965 A1* 8/2007 Inoue ..... G07F 17/3211 463/30
2008/0076513 A1* 3/2008 Esses ..... G07F 17/32 463/20
2008/0090636 A1* 4/2008 Lathrop ..... G07F 17/34 463/20
2008/0096652 A1* 4/2008 Shimizu ..... G07F 17/34 463/31
2008/0287178 A1* 11/2008 Berman ..... G07F 17/3211 463/20
2008/0300037 A1* 12/2008 Wilson ..... G07F 17/3265 463/16
2009/0042636 A1* 2/2009 Taylor ..... G07F 17/32 463/20
2009/0131145 A1* 5/2009 Aoki ..... G07F 17/3211 463/20
2009/0181756 A1* 7/2009 Nguyen ..... G07F 17/3265 463/20
2009/0227328 A1* 9/2009 Saito ..... G07F 17/3202 463/20
2009/0325675 A1* 12/2009 Shai-Hee ..... G07F 17/32 463/20
2010/0216539 A1* 8/2010 Seelig ..... G07F 17/3211 463/20
2015/0031437 A1* 1/2015 Gomez ..... G07F 17/3267 463/20
2015/0170460 A1* 6/2015 Marais ..... G07F 17/3267 463/20

* cited by examiner

EXPANDING HALO REELS GAME

CROSS-REFERENCE TO RELATED APPLICATION

This application claims the benefit of provisional U.S. patent application Ser. No. 62/074,785, filed Nov. 4, 2014, which is incorporated herein by reference for all it discloses.

FIELD OF THE INVENTION

This invention relates to gaming machines and devices, specifically virtual slot machines.

BACKGROUND OF THE INVENTION

Virtual slot machines are well known. Unlike electromechanical slot machines, virtual slot machines have no or very few moving parts. One type of virtual slot machine allows a player to pay money into the machine, make a wager, and initiate play. Initiating play causes the spinning of virtual reels of symbols that are displayed to the player using a graphics display device. Each virtual reel may contain hundreds of symbols available to be displayed in a win evaluation game board. The virtual slot machine generates combinations of symbols randomly and certain winning symbol combinations are associated with awards. When such winning combinations are displayed in the win evaluation game board, the player is entitled to an award, and may collect it immediately or apply it to continue play.

BRIEF SUMMARY OF THE INVENTION

A method of operating a gaming device to play an expanding halo reels game may include the steps of: Displaying a plurality of reels, each of the reels comprising a plurality of symbols; receiving a wager; spinning the reels; stopping the reels; evaluating the stopped reels for a winning combination of symbols; activating a first halo when there is a winning combination of symbols, the first halo comprising a plurality of symbols that surround at least a portion of the reels; moving the first halo with respect to the reels; stopping the first halo; evaluating the stopped first halo and reels for a winning combination of symbols; and terminating game play when there is no winning combination of symbols.

Also disclosed is a method of displaying expanded potential winning symbol combinations on a virtual slot machine game board that may involve the steps of: Spinning a first set of symbol reels on the virtual game board; selecting an initial combination of winning symbols on the virtual game board; increasing the apparent size of the virtual game board to permit the inclusion of additional symbols; and introducing additional symbols to the virtual game board.

A gaming system is also disclosed that may include a display system and an input system for accepting at least one input from a player. A processing system operatively associated with the display system and the input system, operates the display system and input system to: Display a plurality of reels, each of the reels comprising a plurality of symbols; receive a wager from the input system; spin the reels; stop the reels; evaluate the stopped reels for a winning combination of symbols; activate a first halo when there is a winning combination of symbols, the first halo comprising a plurality of symbols that surround at least a portion of the reels; move the first halo with respect to the reels; stop the first halo; evaluate the stopped first halo and reels for a winning combination of symbols; and terminate game play when there is no winning combination of symbols.

Also disclosed is a non-transitory computer-readable storage medium having computer-executable instructions embodied thereon that, when executed by at least one computer processor, cause the processor to: Display on a display system operatively associated with the processor a plurality of reels, each of the reels comprising a plurality of symbols; receive a wager from an input system operatively associated with the processor; spin the reels; stop the reels; evaluate the stopped reels for a winning combination of symbols; activate a first halo when there is a winning combination of symbols, the first halo comprising a plurality of symbols that surround at least a portion of the reels; move the first halo with respect to the reels; stop the first halo; evaluate the stopped first halo and reels for a winning combination of symbols; and terminate game play when there is no winning combination of symbols.

An expanding halo reels game for play on a gaming system having a display may include a plurality of reel symbols that are displayed as a plurality of reels on the display of the gaming system. A plurality of halo symbols arranged to form at least one halo surrounding the plurality of reels is displayed during at least one interval of game play. The expanding reels game spins the reel symbols after receiving a wager from a player, stops the spinning reel symbols after a time interval, and evaluates the stopped reel symbols for a winning combination of reel symbols. The expanding halo reels game activates the at least one halo when there is a winning combination of stopped reel symbols. The expanding halo reels game then moves the activated halo symbols with respect to the reel symbols, stops the moving halo symbols after a time interval, and evaluates the stopped halo symbols and stopped reel symbols for a winning combination of symbols.

BRIEF DESCRIPTION OF THE DRAWINGS

Illustrative and presently preferred exemplary embodiments of the invention are shown in the drawings in which.

DETAILED DESCRIPTION OF THE INVENTION

Various embodiments of an expanding halo reels game 10 according to the teachings of the present invention are shown and described herein as they could be implemented or played on an electronic gaming system 12 of the type well-known in the art. Alternatively, various embodiments of the expanding halo reels game 10 could be implemented on other systems and devices and in other gaming environments, as will be described in greater detail herein.

Figure 1:
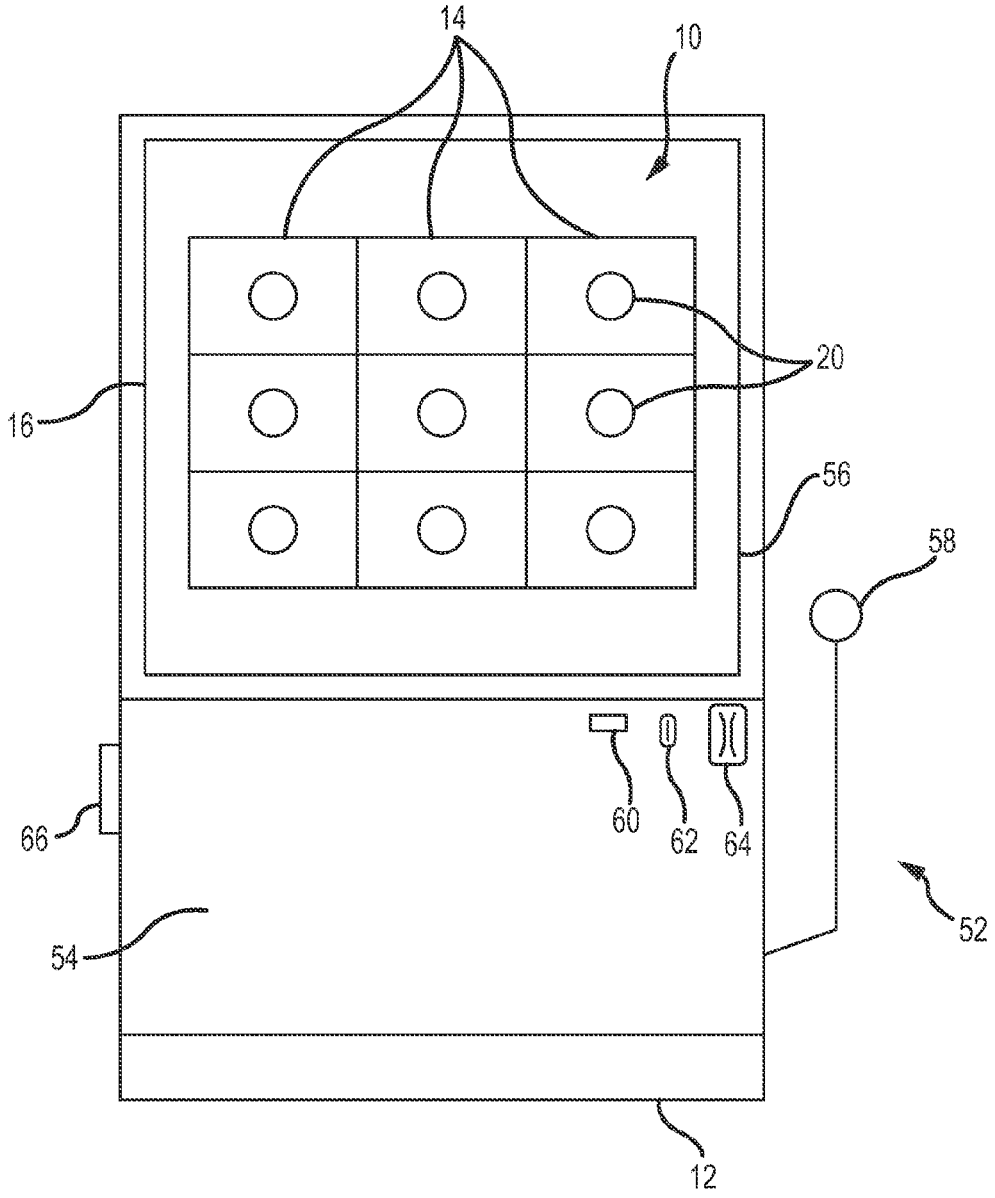
FIG. 1 is a pictorial diagram of an electronic gaming system that may be used to implement the expanding halo reels game of the present invention.
Figures 2A, 2B, 2C:
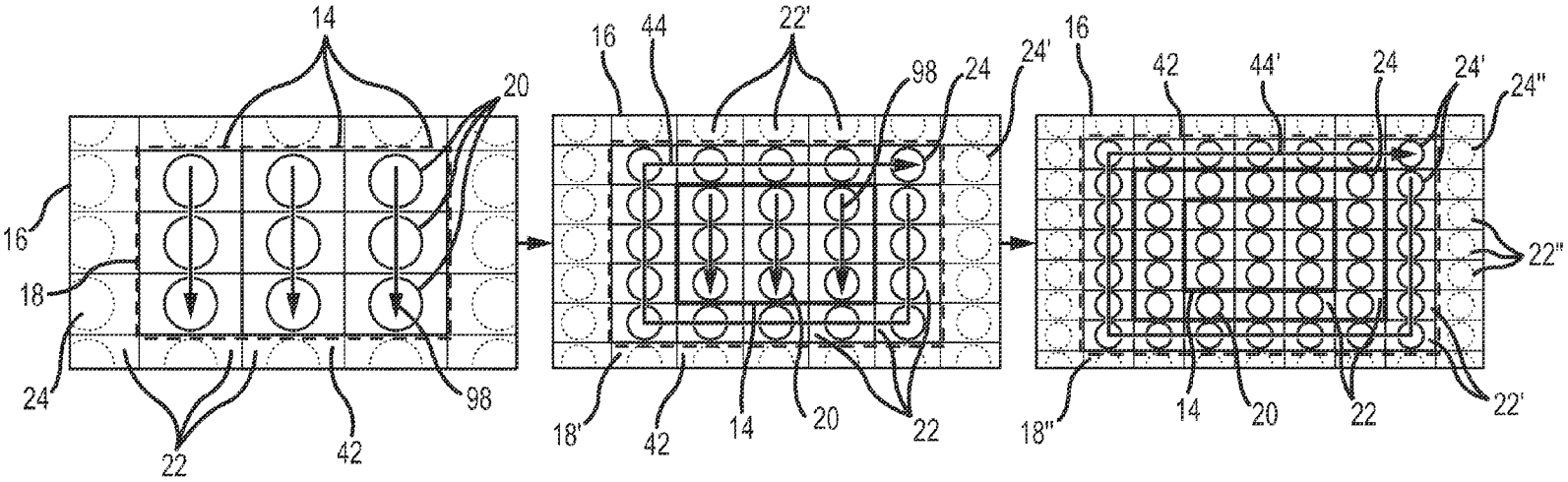
FIGS. 2(*a-c*) are pictorial representations of successive screen displays of a first embodiment of the expanding halo reels game.

Referring primarily to FIGS. 1 and 2(*a-c*), the expanding halo reels game 10 may comprise a plurality of initial reels or reel 'windows' 14 that may be displayed on a display system 16 of the electronic gaming system 12. The reels or reel windows 14 may be displayed within an area or 'game board' 18 also displayed on display system 16. The arrangement may be such that the reels 14 mimic conventional physical reels or reel strips of the type commonly associated with mechanical slot machines, although such an arrangement is not required. Each reel 14 may comprise a plurality of symbols 20 and may be activated or 'spun' at the appropriate time during game play so as to cause the various symbols 20 comprising each reel 14 to appear to a game player (not shown) as if they are spinning, again so as to mimic the spinning reels or reel strips of a conventional mechanical slot machine.

However, and unlike conventional slot machines, the expanding halo reels game 10 may also comprise one or more halos 22 that may be displayed along with reels 14 at appropriate times during game play. Each of the one or more halos 22 may comprise a plurality of symbols 24 arranged so that they surround or encircle the reels 14, as best seen in FIG. 2(*b*). In an embodiment involving the use of multiple halos 22, additional halos (e.g., second and third halos 22' and 22") may be displayed so that the symbols 24 comprising such additional halos 22 surround earlier halos 22 in a nested arrangement, as best seen in FIG. 2(*c*). As will be described in much greater detail herein, the symbols 24 comprising the various halos 22 may be activated, again at appropriate times during game play, so that they move with respect to the other displayed halos 22 and reels 14. The symbols 24 comprising the halo may be evaluated in combination with the symbols 20 of the reels 14 to determine winning combinations of symbols 20, 24.

Figure 3:
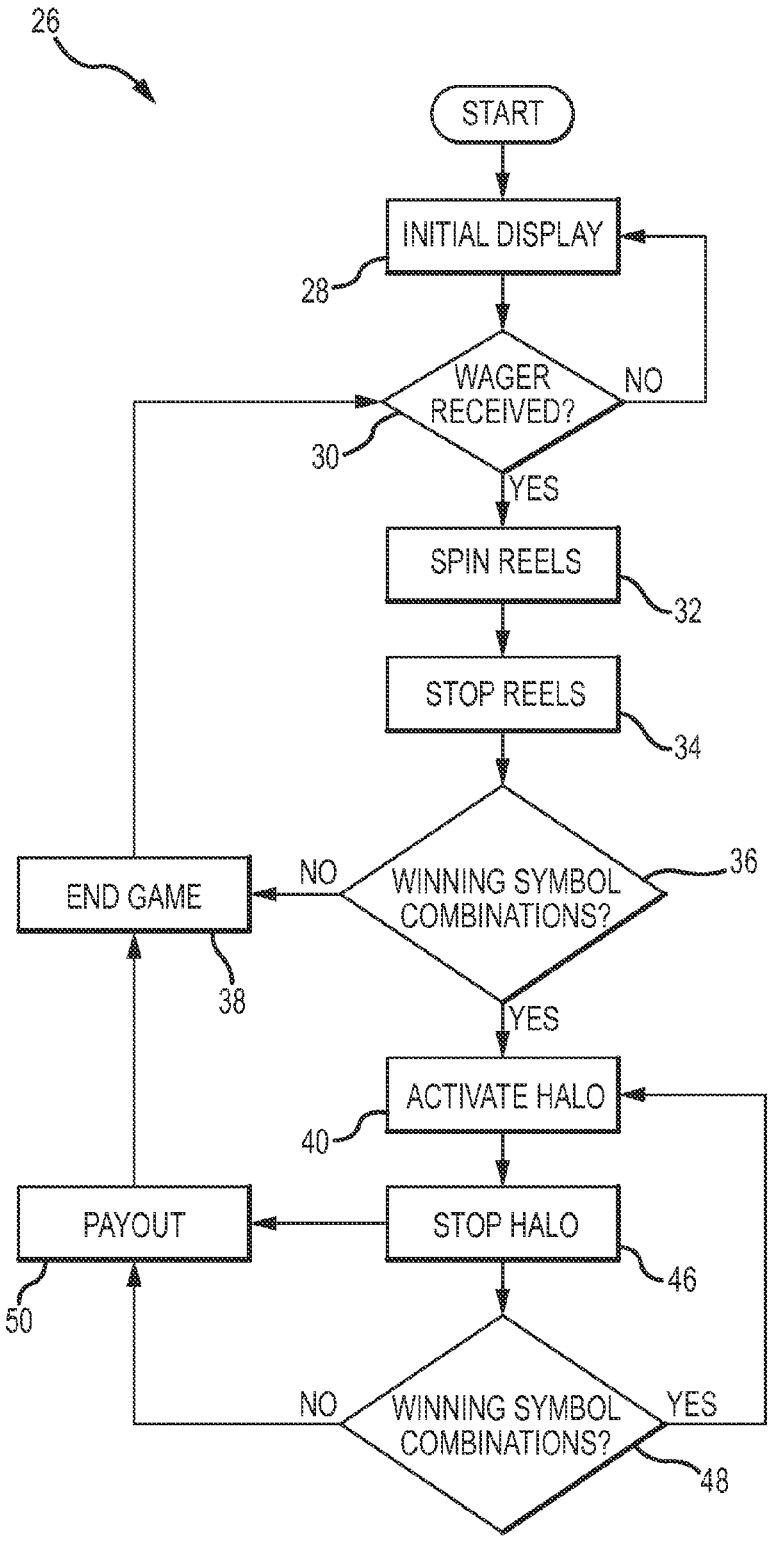
FIG. 3 is a flow chart diagram of one embodiment of a method for playing the expanding halo reels game.

With reference now primarily to FIG. 3 and with occasional reference to FIGS. 1 and 2, the electronic gaming system 12 may be operated in accordance with a method 26 to play the expanding halo reels game 10. A first step 28 in method 26 may involve the initial display of reels 14. The initial display of reels 14 may occur during an idle state, i.e., when the gaming system 12 is awaiting a game player. The initial display of reels 14 may also comprise a time period between when a game player engages the system 12 for play, but before placing a wager. In any event, upon receipt of a suitable wager (e.g., at step 30), the gaming system 12 may activate or spin the reels at step 32. After a suitable interval, the system 12 may stop the reels at step 34 and evaluate, at step 36, the stopped reels 14 for a winning combination of symbols 20. If no winning combination of symbols 20 is found, the method 26 may terminate game play at step 38 and await receipt of a suitable wager.

On the other hand, if a winning combination of symbols 20 is found during evaluation step 36, the method 26 may proceed to step 40 and activate a halo 22. Depending on the particular embodiment, and as will be described in greater detail herein, halo 22 may initially be displayed with reels 14, but as a 'grayed out' or phantom image to alert the player about the possibility of halo activation during game play. Alternatively, halo 22 need not be displayed as a phantom image, but could instead be first displayed (e.g., as a 'regular' image) only upon activation of halo 22, e.g., at step 40. In one embodiment, at or near the same time as halo 22 is activated at step 40, gaming system 12 also may re-size or 'expand' game board 18 using dynamic graphics scaling 13 so that the entireties of the reels 14 and halo 22 may be wholly contained within a perimeter 42 defined by game board 18. In one embodiment, such re-sizing may involve reducing the sizes of the symbols 20 and 24 comprising reels 14 and halo 22, respectively, resulting in the apparent expansion of the game board 18 to include not only the reels 14, but the halo 22 as well. See FIGS. 2(*a*) and 2(*b*). In another embodiment, the gaming system 12 may not resize the game board 18 until after the halo 22 stops spinning in step 46, to be discussed below.

Activation 40 of halo 22 may also involve the relative movement of halo symbols 24 with respect to reels 14. That is, the halo 22 may be moved or 'spun' as well. In some embodiments, the movement of halo 22 with respect to reels 14 may comprise a movement of the halo symbols 24 around the reels 14, as indicated by arrow 44 in FIG. 2(*b-c*). Alternatively, other movement schemes are possible, as will be described in further detail herein. Depending on the embodiment, the reels 14 may or may not be re-spun during halo activation step 40.

After a suitable interval in which the symbols 24 of halo 22 are allowed to move or spin, method 26 may stop the movement of halo 22 around reels 14 at step 46. Thereafter, method 26 may proceed to evaluate, at step 48, the stopped reels 14 and halo 22 for winning symbol combinations. If no winning combination of symbols 20, 24 is found, the method 26 may pay out any winnings, at step 50, end the game (e.g., at step 38), and/or await receipt of a suitable wager at step 30.

If, on the other hand, a winning combination of symbols is found during evaluation step 48, method 26 may return to step 40 and activate a (second) halo 22'. See FIG. 2(*c*). The activation of a second halo 22' may be substantially identical to the activation of the first halo 22 already described. For example, and with reference now primarily to FIG. 2(*c*), second halo 22' could comprise a plurality of halo symbols 24' that are displayed around the first halo 22. Up to this point, second halo 22' may have been displayed as a phantom image (depicted in FIG. 2(*b*) in this example), with the various symbols 24' comprising the second halo 22' shown as greyed out or phantom images around the first halo 22. Alternatively, second halo 22' need not have been displayed up to this point, in which case the activation step 40 will involve the display of a regular image of second halo 22'. Here again, at or about the same time that second halo 22' is activated (e.g., at step 40), gaming system 12 may re-size or 'expand' game board 18 (e.g., by reducing the sizes of the symbols 20, 24, 24' comprising reels 14, first halo 22, and second halo 22', respectively) so that the entireties of the reels 14 and halos 22 and 22' may be wholly contained within the perimeter 42 of game board 18. See FIGS. 2(*b*) and 2(*c*).

The activation 40 of second halo 22' may also involve the relative movement of second halo symbols 24' with respect to first halo 22 and reels 14. In some embodiments, the movement of the second halo symbols 24' with respect to first halo 22 and reels 14 may comprise an encircling movement, as indicated by arrow 44', although other movement schemes are possible. Also, depending on the embodiment, first halo 22 and/or reels 14 may or may not be re-spun during activation of second halo 22'.

After a suitable or desired interval of moving the symbols 24' of second halo 22', method 26 may stop the movement of second halo 22' at step 46. Method 26 may thereafter evaluate (e.g., at step 48), the stopped reels 14 and halos 22, 22' for winning symbol combinations. If no winning combination is found, the method 26 may pay out any winnings (e.g., at step 50), end the game (e.g., at step 38) and/or await receipt of a suitable wager at step 30. Alternatively, the method 26 may return again to steps 40, 46, and 48 to activate, stop, and evaluate additional halos 22 until no winning combinations of symbols are found.

A significant advantage of the expanding halo reels game 10 according to the teaching of the present invention is the addition of a unique variable to the virtual slot machine gaming experience. The additional win combinations made possible by this method permit multiple wins and payouts during a single play experience, and the dynamic graphics scaling communicates the method to players in a visually engaging style. Still further, the halo symbol concept embodied in the present invention is intuitive to players, who will immediately recognize its purpose and the additional winning combinations it can generate when they see it in action. As a consequence, the expanding halo reels game may attract new players to the gaming system and retain them longer throughout successive games.

Having briefly described the expanding halo reels game, as well as some of its more significant features and advantages, various exemplary embodiments and alternative configurations of the expanding halo reels game will now be described in detail. However, before proceeding with the detailed description it should be noted that while the expanding halo reels game is shown and described herein as it could be embodied or played on an electronic gaming system 12 of the type well-known in the art in a casino environment, the present invention is not limited to play on such devices and in such environments. For example, alternative embodiments could be implemented as specific gaming applications provided on a wide variety of computer systems, such as personal computer systems, 'smart' phones, and tablet computers, that are operatively connected to a suitable gaming network. Consequently, the present invention should not be regarded as limited to the particular devices, networks, and gaming environments shown and described herein.

Referring back now to FIG. 1, in one embodiment the electronic gaming system 12 may include a display system 16, an input system 52 to accept an input from a player, and a processing system 54. The display system 16 may comprise a video touchscreen 56, although a touchscreen is not required. If a touchscreen 56 is provided, then it may comprise a part of the input system 52. Input system 52 may comprise a handle 58 that may be used by a player to initiate the reel spinning sequence. In addition, input system 52 may also comprise any of a wide range of other devices, such as one or more buttons 60, coin slots 62, and card readers 64, either separately or in combination with the handle 58, in order to allow a player to provide the necessary or desired input.

The electronic gaming system 12 may also comprise a communications module 66. The communications module 66 may be operatively associated with the processing system 54 of the electronic gaming system 12 so as to allow the gaming system 12 to communicate with a network 86. The communications module 66 may comprise any of a wide variety of communications devices, such a devices configured to communicate via Ethernet, 12C, RD-232, USB, RS-485, IEEE 1394, or Netplex communications technology, as would become apparent to a person having ordinary skill in the art after become familiar with the teachings provided herein. Communications module 66 may also utilize other communication interfaces now employed by, or that may be developed for use by, the gaming industry. The communications module 66 may operate on or interface with wired or wireless channels, and may be used to communicate with personal devices operating through known wireless technologies.

Figure 4:
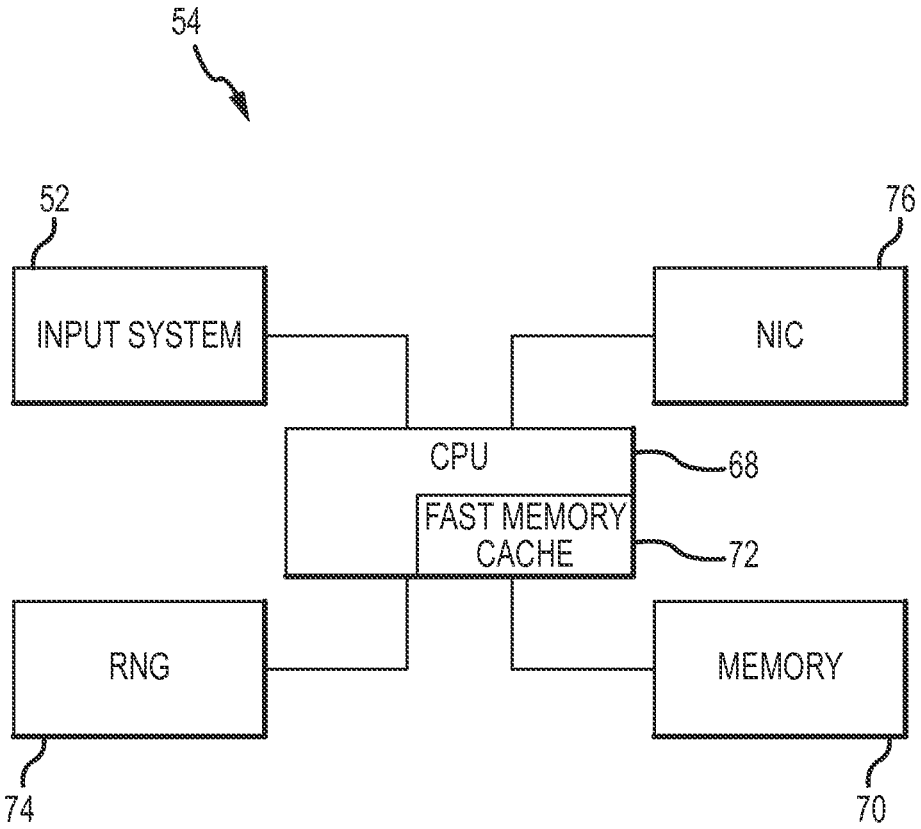
FIG. 4 is a schematic representation of the major components of the electronic gaming system illustrated in FIG. 1.

With reference now primarily to FIG. 4, the processing system 54 of electronic gaming system 12 may comprise a logic component that is operatively connected to internal components that manage the various gaming systems and operations for the electronic gaming system 12 that are imbedded in software and implemented by a central processing unit (CPU) 68. In one embodiment, the processing system 54 of the electronic gaming system 12 may comprise the CPU 68 and a memory storage mechanism 70 for storing gaming operations and processes for the method 26. CPU 68 may use a fast memory cache 72 to access data or software stored in the memory 70 more efficiently. In another embodiment, the memory 70 may comprise a non-transitory computer-readable storage medium having computer-executable instructions embodied within so that, when executed by the CPU 68, cause the processor to display and carry out the steps of the expanding halo reels game 10 on the display system 16 of the electronic gaming system 12. The logic component is not limited to the CPU 68 and instead may include a plurality of logic gates and switches that may either be programmed (e.g., a field programmable gate array) or may be an application-specific integrated circuit (e.g., an ASIC).

In an embodiment, CPU 68 may implement the method 26 via instructions imbedded in software and stored in the memory 70. The input system 52 may permit the player to interact with the method 26 and input desired parameters to the game, with the processing system 54 processing the player's inputs and executing them according to the software stored in the memory 70.

The software may include a random number generator (RNG) 74 for randomly selecting reel symbols 20 and halo symbols 24 for the electronic gaming system 12 to display on display system 16. These reel symbols 20 and halo symbols 24 may comprise numbers, letters, geometric figures, animated figures, words, bonus multipliers, or pictures. The reel symbols 20 and halo symbols 24 may also comprise wild symbols, multipliers, bonus symbols, credit awards, or other special feature symbols of the type well-known in the art. In an embodiment, random number selection may comprise using the RNG 74 as a basis for selecting reel symbols 20 or halo symbols 24 from a set of game symbols for the electronic gaming system 12 to display on display system 16. In an embodiment, the set of reel symbols 20 that may appear in the reel windows 14 may comprise a set of approximately 300 symbols for each reel. In another embodiment, the system and method of selecting symbols from among the set of game symbols may simulate systems that provide for random number generation. By way of non-limiting example, a well-known lottery-based system may be used.

Figure 5:
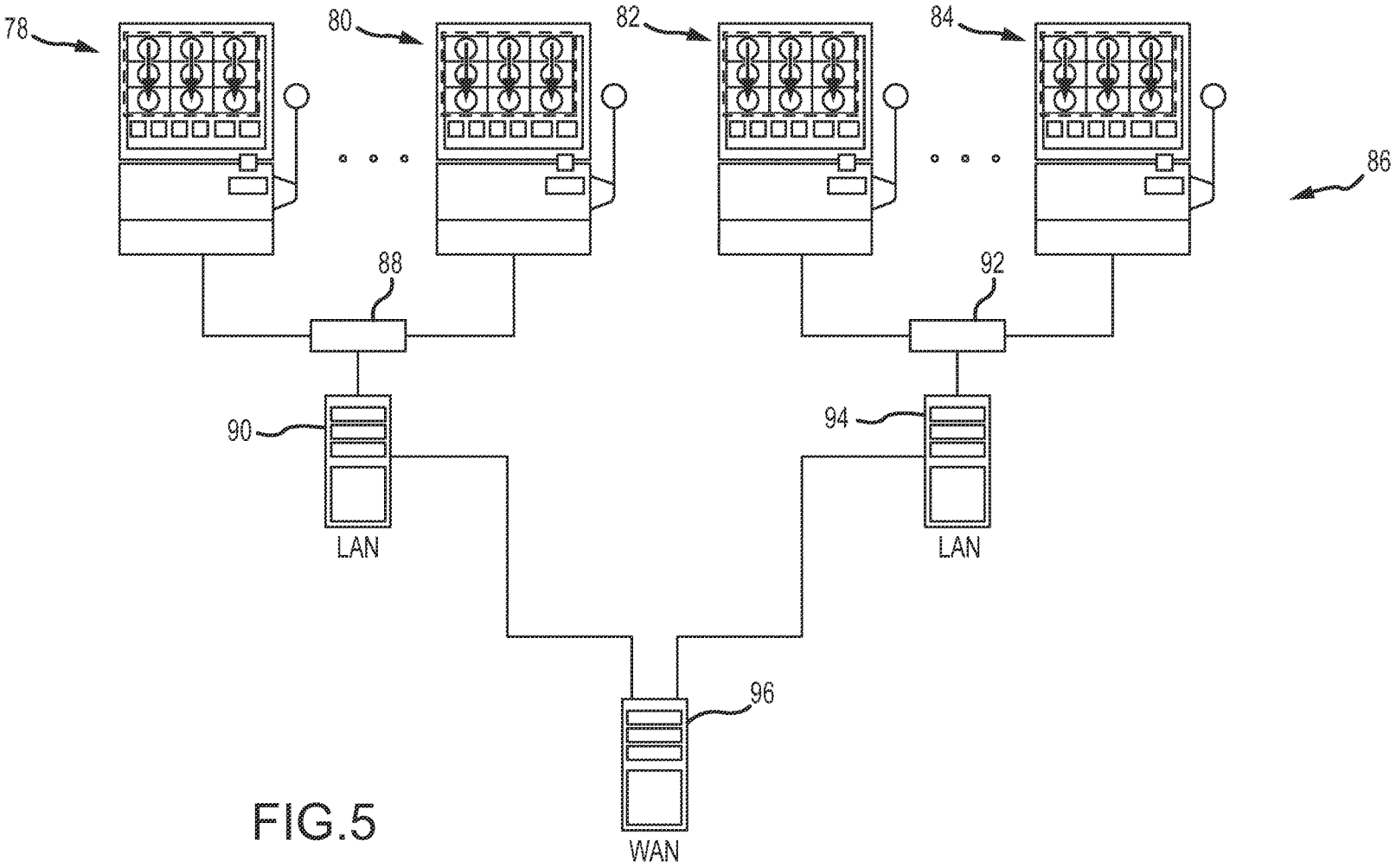
FIG. 5 is a schematic representation of a network of electronic gaming systems that may be used to implement the expanding halo reels game.
Figure 6A:
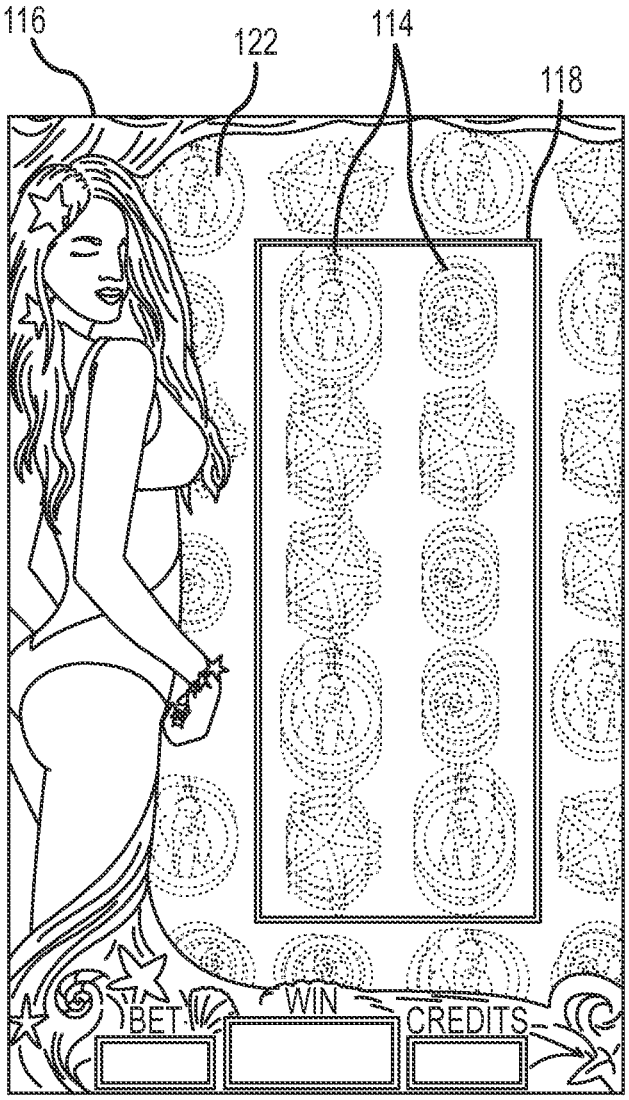
FIGS. 6(*a-d*) are pictorial diagrams of a second embodiment of an electronic gaming system of the expanding halo reels game.
Figure 6B:
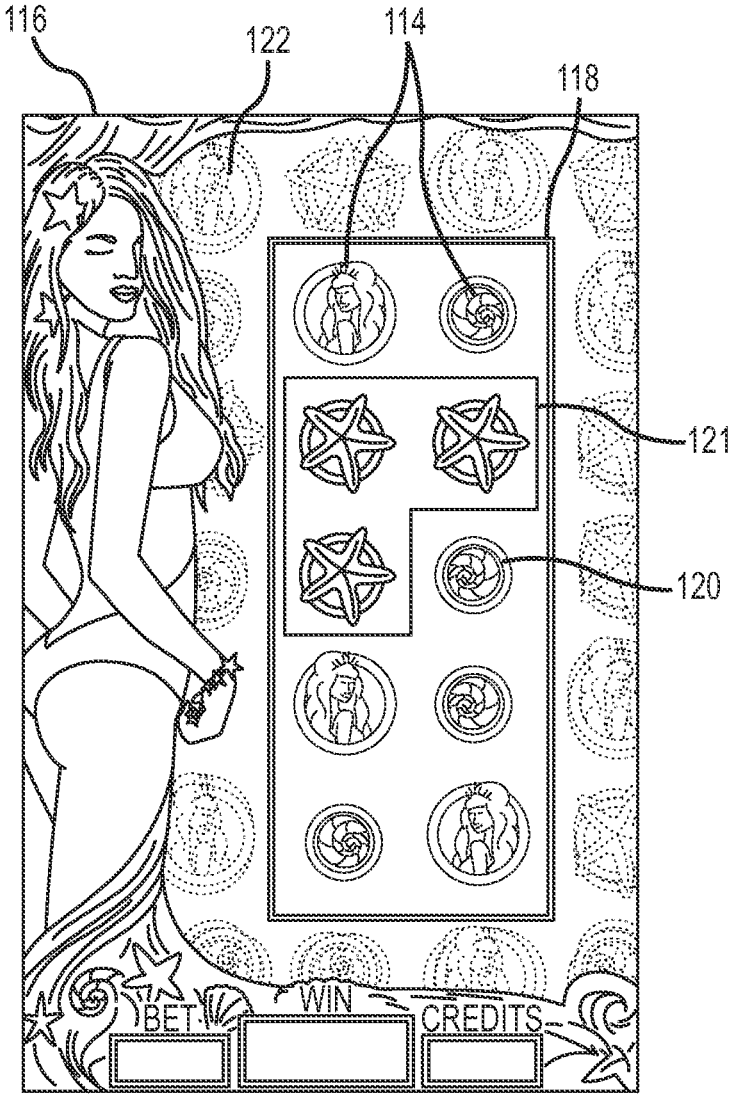
Figure 6C:
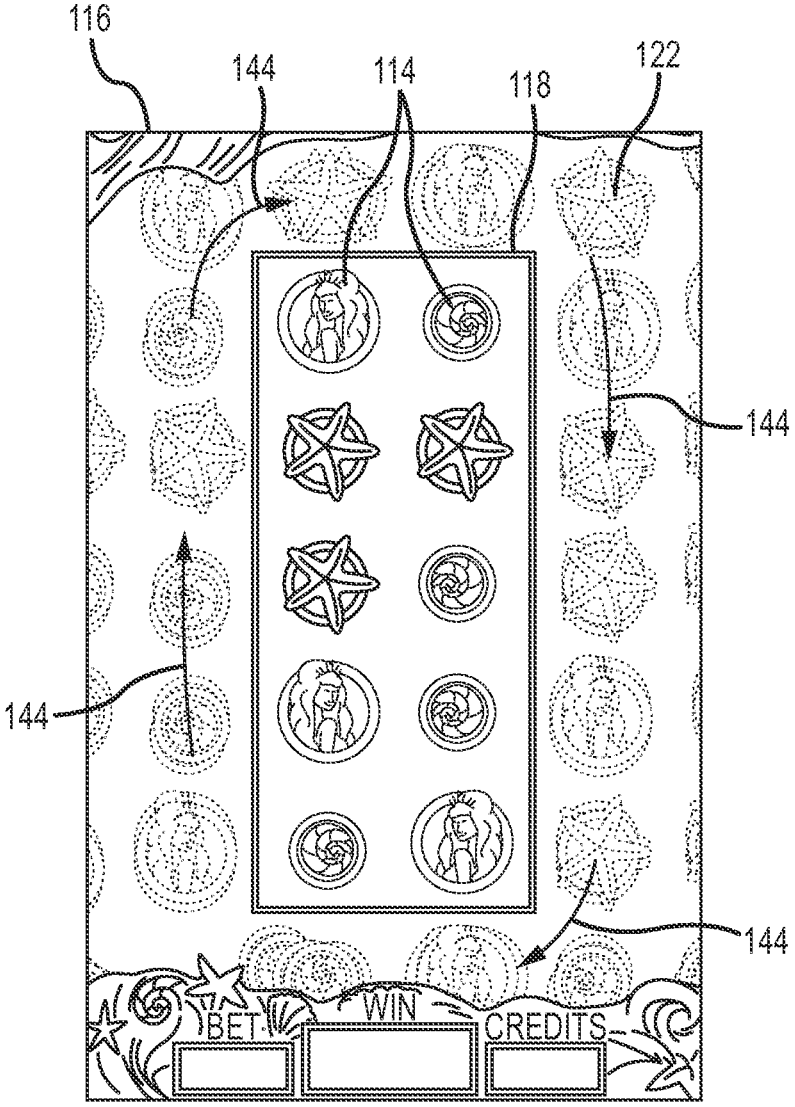
Figure 6D:
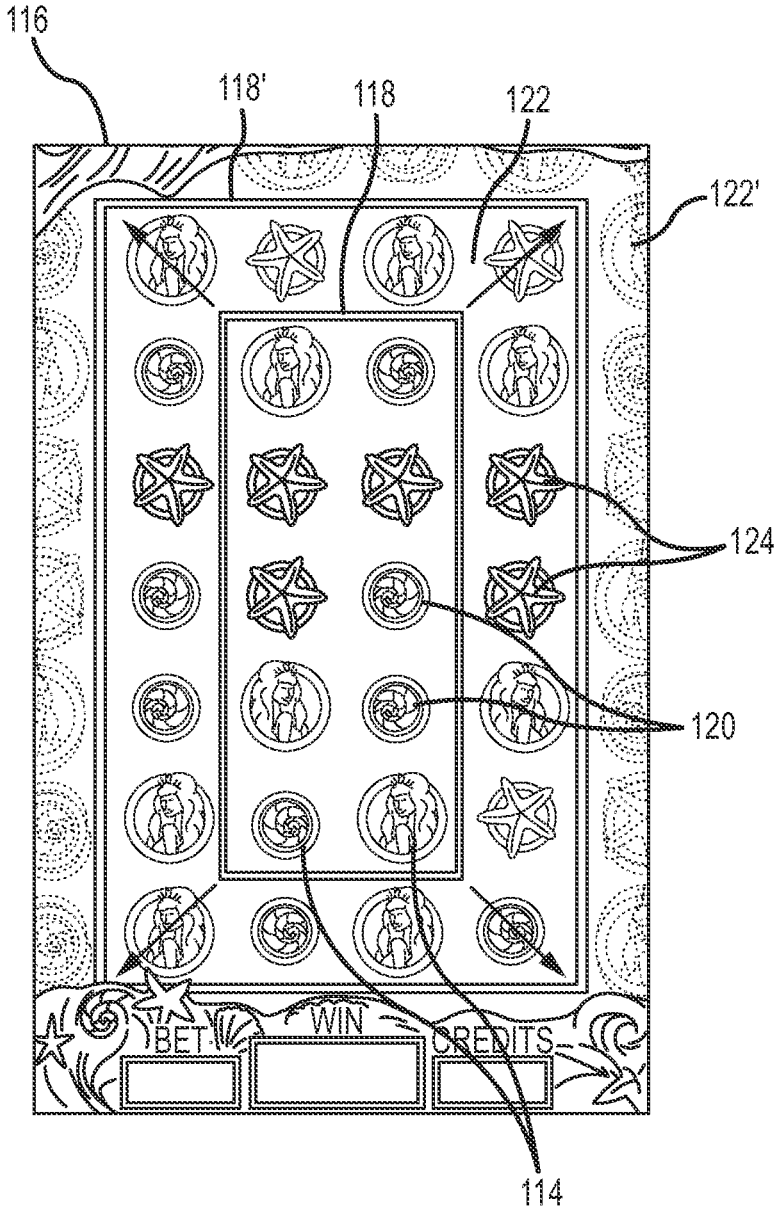

Referring now to FIGS. 4 and 5, in an embodiment, the processing system may also comprise a network interface card (NIC) 76 to permit communications between a plurality of electronic gaming systems 78-84 and processors within a network 86. The NIC 76 may use well-known networking protocols to communicate with other networked devices. The electronic gaming systems 78-84 may be networked together to allow for a progressive jackpot, in which the sum of the potential winning prizes is shared between the electronic gaming systems 78-84 on the network 86.

As illustrated in FIG. 5, the network 86 may comprise the networked electronic gaming systems 78-84, each of which may be similar to the electronic gaming system 12 described above. The networked gaming systems 78 and 80 may connect to a node 88, which communicates with a local area network (LAN) server 90. The networked gaming systems 82 and 84 may connect to a node 92, which communicates with a LAN server 94. The notes 88 and 92 may be hubs, routers, bridges, gateways, or similar communications devices that permit communications between the networked gaming systems 78-84. A wide area network (WAN) may be created by linking the LANs 90 and 94 with a WAN server 96. WANs and LANs are well known and may operate in a similar manner, but may be differentiated by geography (e.g., casino floors versus different casinos).

The electronic gaming system 12 may be operated in accordance with method 26 to implement or play the expanding halo reels game 10. With reference primarily to FIG. 3 and with occasional reference to FIGS. 1 and 2, a first step 28 in method 26 may involve the initial display of reels 14 on a game board 18. In this embodiment, the game board 18 contains three initial reels 14, each of which contains three symbols 20. The first halo 22 and its symbols 24 are partially visible, being shown as a grayed out phantom image to indicate that it is not yet in play. Other embodiments of the expanding halo reels game 10 may display other initial reel 14 arrangements, such as different numbers of initial reels 14 or different numbers of symbols 20 contained within each reel. Additionally, other embodiments of the expanding halo reels game 10 may not display the first halo 22 at the initial display step 28 at all, and may introduce the halo 22 only after the method 26 detects a first winning symbol combination at step 36 and activates the halo 22 at step 40.

The game player may input a wager e.g., at step 30, and the method 26 moves to step 32 and spins the three reels 14. In this embodiment, the reels 14 spin in a vertical downward direction 98. In other embodiments, the reels 14 may spin in a horizontal direction 100. After a suitable interval, the method 26 stops the reels 14 at step 34 and evaluates them at step 36 for a winning combination of symbols 20. The method 26 can perform this evaluation in a variety of ways typically known in the art, including a horizontal payline of matching symbols 20, a vertical payline of matching symbols 20, adjacent clusters of matching symbols 20, diagonal or bending paylines of matching symbols 20, or a 'ways pays' combination of matching symbols 20. In this embodiment, the method 26 detects a winning combination of symbols 20, and proceeds to step 40 and activates a halo 22.

FIG. 2(*b*) depicts the entry and movement of the halo 22 during step 40. The gaming system 12 implements dynamic graphics scaling 13 to reduce the size of the symbols 20 contained within the game board 18 and communicate the subjective sensation of "zooming out" from the game board 18 to the player. The additional space on the virtual game board 18' permitted by the reduction in size of the reels 14 and symbols 20 permits the symbols 24 of the halo 22 to encircle the reels 14 and to move around the reels 14 while remaining within the perimeter 42 of the game board 18'. In this embodiment, the reels 14 spin in a vertical downward direction 98 while the halo 22 spins around the reels 14 in a clockwise direction 44. In other embodiments, the reels 14 may remain stationary while the halo 22 moves around them, or the halo 22 may move around the reels in a counterclockwise direction 45.

After a period of time, the method 26 stops the movement of the halo 22 at step 46, and proceeds to evaluate at step 48 possible winning combinations of symbols 20 and 24. At this time, as shown in FIG. 2(*b*), a second halo 22' with its associated symbols 24' is inactive but partially visible, grayed out in a phantom image, outside the boundary of the game board 18'. In other embodiments, the second halo 22' may not be visible at all until it is activated in step 40 after the method 26 detects a winning combination of symbols 20 and 24 in evaluation step 48.

Here, the method 26 detects a winning combination of symbols 20 and 24 in evaluation step 48, and proceeds to step 40 and activates a second halo 22'. The gaming system 12 again implements dynamic graphics scaling 13 to reduce the size of the symbols 20 and 24 contained within game board 18' and to create game board 18", which permits the inclusion of the second halo 22' as depicted in FIG. 2(*c*). In this embodiment, the second halo 22' moves in a clockwise direction 44' around the first halo 22 and reels 14, which do not move; in other embodiments, the first halo 22 and reels 14 may move or spin while the second halo 22' moves around them.

After a period of time, the method 26 stops the movement of the second halo 22' at step 46, and proceeds to evaluate at step 48 possible winning combinations of symbols 20, 24, and 24'. At this time, a third halo 22" with its associated symbols 24" is inactive but partially visible, grayed out in a phantom image, outside the boundary of the game board 18". If the method 26 detects a third winning combination of symbols 20 after stopping the third halo 22" in step 46, the method 26 may continue to cycle through steps 40, 46, and 48 to activate, stop, and evaluate additional halos 22 until no further winning combinations of symbols are found.

FIG. 6 depicts an illustrative but non-limiting second embodiment of the expanding halo reels game 10, gaming system 12, and method 26. FIG. 6(*a*) depicts the image displayed on display system 116, and depicts the point in this second embodiment of the expanding halo reels game 110 at which the player has input a wager in step 30 of the method 26 and spun the initial reels 114 in step 32. In FIG. 6(*a*), the display system 116 also depicts the first halo 122, which is not yet in play and is displayed as a grayed out phantom image beyond the border of the game board 118.

FIG. 6(*b*) depicts the expanding halo reels game 110 just after the initial reels 114 stop during step 34 of the method 26. The method 26 evaluates 36 the stopped initial reels 114 for a winning combination of symbols 120, and locates a winning combination of symbols 120 in the form of the three adjacent star-shaped symbols 121. The method 26 proceeds to step 40, and activates the first halo 122, the movement of which is depicted in FIG. 6(*c*).

In this second embodiment and as is shown in FIG. 6(*c*), the halo 122 moves around the reels 114 after being activated in step 40, as shown by the directional arrows 144 in FIG. 6(*c*). In this embodiment, the reels 114 remain stationary as the halo 122 moves around them. FIG. 6(*d*) depicts step 46 of the method 26, in which the halo 122 stops spinning. The gaming system 112 implements dynamic graphics scaling 113 to reduce the size of the symbols 120 contained within the game board 118 and to create game board 118', which permits the inclusion of the symbols 124 of the stopped halo 122 along with the original symbols 120 of the initial reels 114. The method 26 performs step 48 to check for winning symbol combinations between the reels 114 and halo 122. In this embodiment, a second winning symbol combination occurs, and the method 26 returns to step 40 to activate a second halo 122', which is depicted in FIG. 6(*d*) as a grayed out phantom image beyond the boarder of the game board 18'. If the method 26 detects a second winning combination of symbols 120 after stopping the second halo 122' in step 46, the method 26 may continue to cycle through steps 40, 46, and 48 to activate, stop, and evaluate additional halos 122 until no further winning combinations of symbols are found.

Figures 7A, 7B:
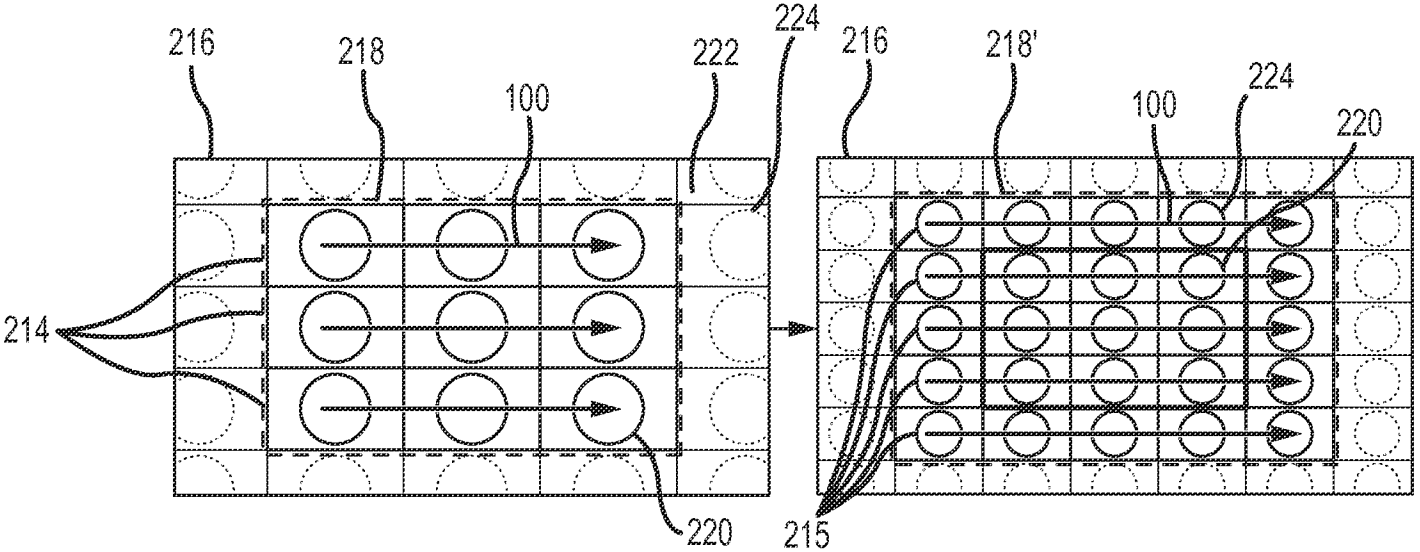
FIGS. 7(*a,b*) are pictorial representations of successive screen displays of a third embodiment of the expanding halo reels game.

FIG. 7 depicts a third illustrative but non-limiting embodiment of the expanding halo reels game 10 and method 26. As depicted in FIG. 7(*a*), in this embodiment, the reels 214 spin in a horizontal left-to-right direction 100 when the method 26 performs step 32. The first halo 222 and its symbols 224 are partially visible outside the game board 218 as a grayed out phantom image that is not yet in play. After a suitable interval, the method 26 stops the reels 214 at step 34 and evaluates them at step 36 for a winning combination of symbols 220. In this embodiment, the method 26 detects a winning combination of symbols 220, and proceeds to step 40 and activates the halo 222.

As is depicted in the transition from FIG. 7(*a*) to FIG. 7(*b*), the gaming system 212 implements dynamic graphics scaling 213 to expand the game board 218 into the larger game board 218'. In this embodiment, it is the expansion of the game board 218 to encompass the grayed out phantom halo 222 that activates the halo 222 and carries out step 40, rather than movement on the part of the halo 222 as it enters the game board 218', as is described in previous embodiments. The new game board 218' shown in FIG. 7(*b*) contains the initial reels 214 and the halo 222, and in step 40 all five of these reels 215 spin in a horizontal left-to-right direction 100. After a suitable interval, the method 26 stops the reels 215 at step 46 and evaluates them at step 48 for a winning combination of symbols 220 and 224. If another winning combination of symbols 220 and 224 is found, the method 26 may continue to cycle through steps 40, 46, and 48 to activate, stop, and evaluate additional halos 222 until no further winning combinations of symbols are found.

Figure 8B:
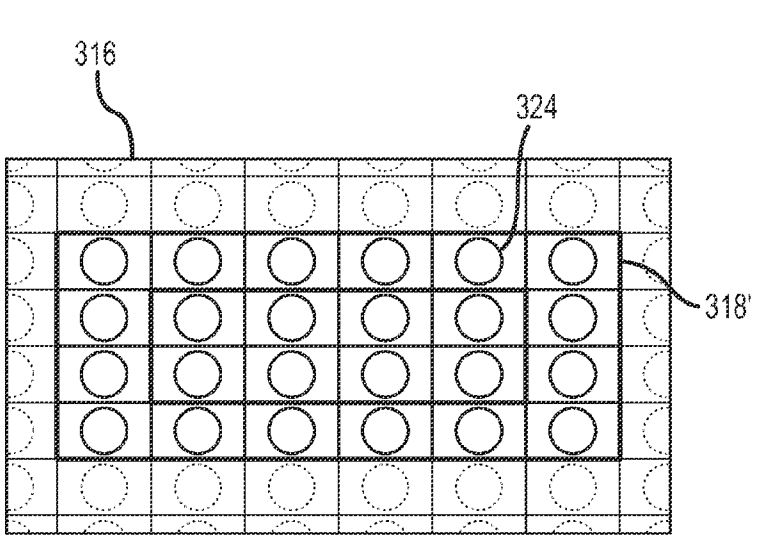
FIGS. 8(*a,b*) are pictorial representations of successive screen displays of a fourth embodiment of the expanding halo reels game.
Figure 8A:
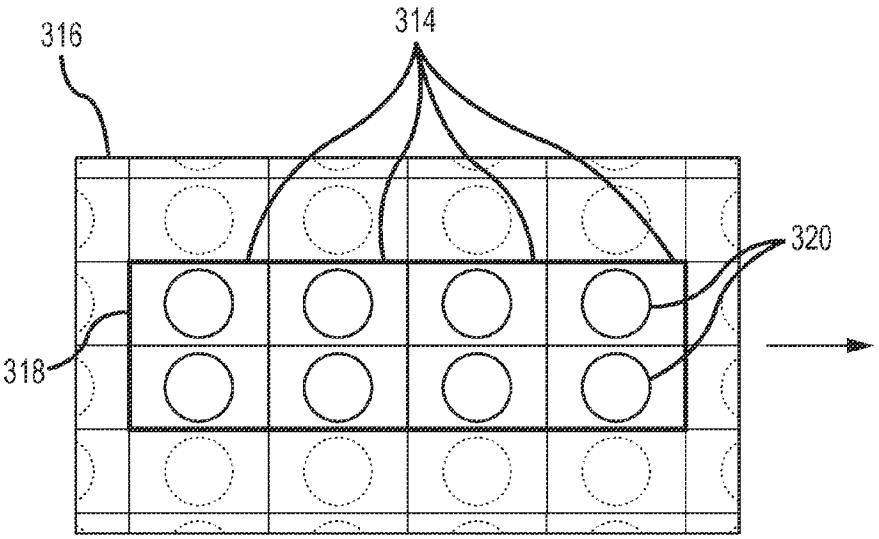

In different non-limiting embodiments, the gaming system 12 may implement the method 26 on a variety of configurations of initial reels 14. In the fourth embodiment depicted in FIG. 8(*a*), the game board 318 begins with four initial symbol reels 314, each of which displays two symbols 320 at a time. The gaming system 312 implements the method 26 described above when the player inputs a wager 30 and the initial reels 314 spin in step 32. The reels 314 stop spinning 34 and the method 26 evaluates 36 the reels 314 for a winning combination of symbols 320. In this embodiment, the method 26 detects a winning combination and activates a halo 322 in step 40. As illustrated in FIG. 8(*b*), the halo's 322 entry to the game board 318' expands the number of symbols 320 and 324 visible to the player into six columns of four symbols each, and the method 26 continues according to the steps described above.

Figure 9B:
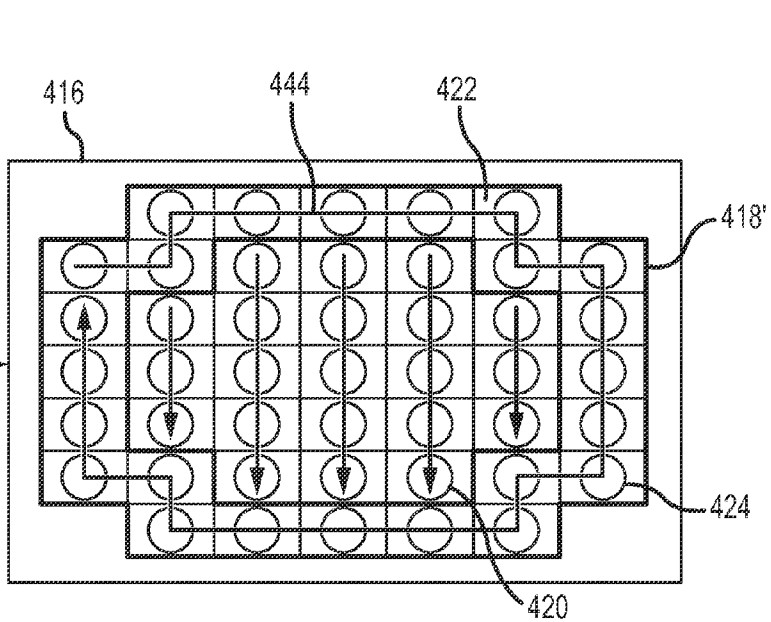
FIGS. 9(*a,b*) are pictorial representations of successive screen displays of a fifth embodiment of the expanding halo reels game.
Figure 9A:
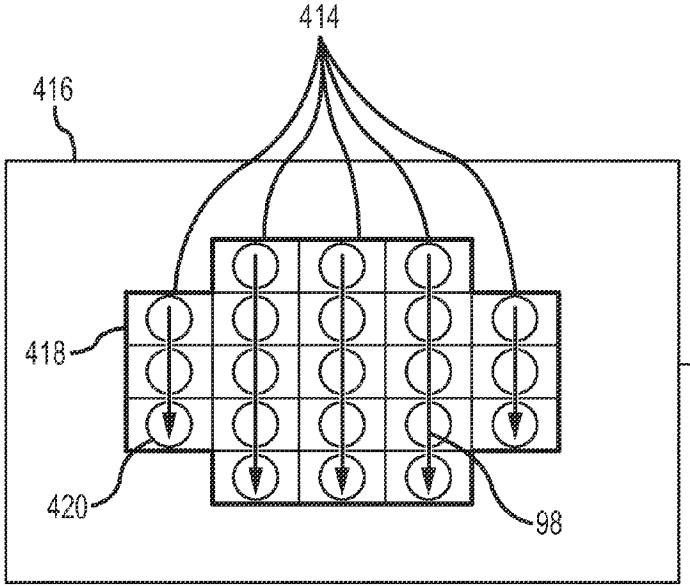

In a fifth embodiment, illustrated by FIG. 9, the game board 418 begins in FIG. 9(*a*) with an asymmetrical set of initial reels 414, of which two contain three symbols 420 each and three contain five symbols 420 each. The gaming system 412 implements the method 26 described above when the player inputs a wager 30 and the initial reels 414 spin in step 32. The reels 414 spin in a downward direction 98, and when they stop at step 34, the method 26 evaluates 36 the reels 414 for a winning combination of symbols 420. In this embodiment, the method 26 detects a winning combination and activates a halo 422 in step 40. In this embodiment, the halo 422 was not visible in any way on the display system 416 before being activated in step 40. As shown in FIG. 9(*b*), the gaming system 412 resizes the game board 418 into game board 418' to permit room for the halo 422 to enter. The halo 422 enters the game board 418' in a clockwise direction 444 on a path that follows the visual contours of the initial symbol reels 414, and surrounds them. The addition of the halo 422 increases the number of symbols 420 visible to the player into two columns of five symbols each and three columns of seven symbols each. The method 26 then continues according to the steps described above.

Figure 10B:
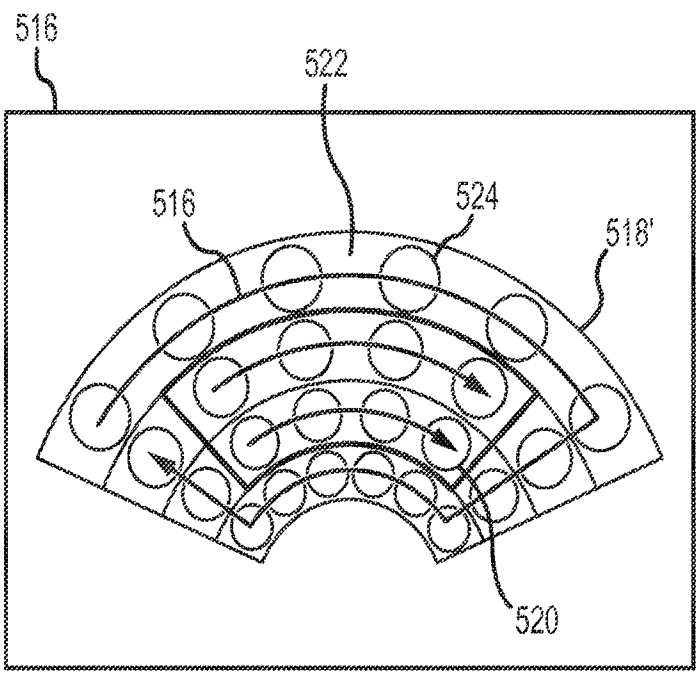
FIGS. 10(*a,b*) are pictorial representations of successive screen displays of a sixth embodiment of the expanding halo reels game.
Figure 10A:
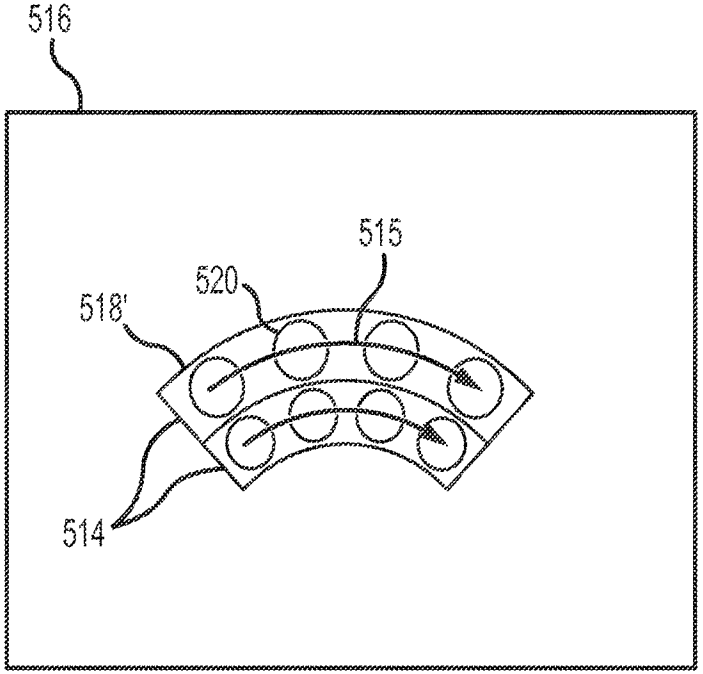

In a sixth embodiment, illustrated by FIG. 10, the game board 518 begins with a set of curved initial symbol reels 514, each of which contains four symbols 520, as depicted in FIG. 10(*a*). The gaming system 512 implements the method 26 described above when the player inputs a wager 30 and spins the initial reels 514. In this embodiment, the initial reels 514 spin in a clockwise curved direction 515 that visually mimics the path of a spinning wheel. The initial reels 514 stop spinning 34 and the method 26 evaluates 36 the initial reels 514 for a winning combination of symbols 520. In this embodiment, the method 26 detects a winning combination and activates a halo 522 in step 40. In this embodiment, the halo 522 was not visible in any way on the display system 516 before being activated in step 40. As shown in FIG. 9(*b*), the gaming system 512 resizes the game board 518 into game board 518' to permit room for the halo 522 to enter. The halo 522 enters the game board 518' in a clockwise curved direction 516, on a path that follows the curved visual contours of the initial symbol reels 514, and surrounds them. The addition of the halo 522 increases the number of symbols 520 visible to the player into six columns of four symbols each, arranged in a curved array. Method 26 then continues according to the steps described above.

The gaming device 12 may employ the steps of method 26 described above to add halos to initial symbol reels of any configuration or shape. The examples above are intended to be illustrative but non-limiting and non-exhaustive.

Having herein set forth the various embodiments of the present invention, it is anticipated that suitable modifications can be made thereto which will nonetheless remain within the scope of the invention.

What is claimed is:

1. A computer implemented method for operating an expanding halo game that uses an expanding halo in an expanding halo electronic gaming system having a display system operable to present a reel window, an input system operable to receive both a monetary value input and a reel spinning sequence initiating input, a memory storing one or more gaming operations, and one or more processing units configured to perform the expanding halo reels game operations, the method comprising:

displaying on the display system a plurality of symbol reels comprising a first visual contour, each of the plurality of symbol reels comprising a first plurality of symbols;

receiving at the monetary value input a wager;

displaying on the display system spinning one or more of the plurality of symbol reels on a virtual game board;

stopping the one or more plurality of symbol reels on the virtual game board;

evaluating one or more of the stopped plurality of symbol reels for a first winning combination of symbols;

activating on the gaming system a first halo when there is the first winning combination of symbols, the first halo comprising a second visual contour and a second plurality of symbols that surround at least a portion of the plurality of symbol reels;

rotating the first halo around the plurality of symbol reels in a first one of a clockwise or counterclockwise direction on a path that follows the first visual contour;

stopping the first halo rotation;

evaluating the stopped first halo and the plurality of symbol reels for a second winning combination of symbols; and terminating game play when there is no second winning combination of symbols.

2. The method of claim 1, further comprising:

activating on the gaming system a second halo when there is the second winning combination of symbols, the second halo comprising a third plurality of symbols that surround at least a portion of the first halo;

rotating the second halo around the first halo in one of a clockwise or counterclockwise direction with respect to the first halo on a path that follows the second visual contour;

stopping the second halo rotation; and evaluating the stopped second halo, the first halo, and the plurality of symbol reels for a third winning combination of symbols.

3. The method of claim 2, further comprising:

rotating the first halo around the plurality of symbol reels in the first one of a clockwise or counterclokwise direction while rotating the second halo around the first halo in the second direction, wherein the second direction is counter to the first clockwise or counterclokwise direction.

4. The method of claim 2, further comprising:

a) activating on the gaming system a third halo when there is the third winning combination of symbols, the third halo comprising a fourth plurality of symbols that surround at least a portion of the second halo;

b) rotating the third halo in a third clockwise or counterclokwise direction;

c) stopping the third halo rotation;

d) evaluating the stopped third halo, the second halo, the first halo, and the plurality of symbol reels for a fourth winning combination of symbols; and e) repeating a) through d) so long as there is a fourth winning combination of symbols.

5. The method of claim 1, wherein said evaluating the stopped first halo and the plurality of symbol reels for the second winning combination of symbols further comprises:

defining a payline; and evaluating the stopped first halo and the plurality of symbol reels along the payline for the second winning combination of symbols.

6. The method of claim 1, wherein said evaluating the stopped first halo and the plurality of symbol reels for the second winning combination of symbols further comprises:

defining a ways pays combination; and evaluating the stopped first halo and the plurality of symbol reels along the ways pays combination for the second winning combination of symbols.

7. The method of claim 1, wherein the virtual game board defines a perimeter, and wherein the plurality of symbol reels are displayed within the perimeter of the virtual game board.

8. The method of claim 7, further comprising displaying as a first phantom image at least a portion of the first halo prior to activating the first halo, along with the plurality of symbol reels.

9. The method of claim 8, wherein activating the first halo comprises:

displaying on the display system the first halo as a regular image; and resizing the displayed first halo and the plurality of symbol reels so that the first halo and the plurality of symbol reels fit within the perimeter of the virtual game board.

10. The method of claim 9, further comprising displaying on the display system as a second phantom image at least a portion of a second halo prior to activating the second halo around the resized display of the first halo and the plurality of symbol reels on a path that follows the second visual contour, the second halo comprising a third plurality of symbols that surround at least a portion of the first halo.

11. The method of claim 10, further comprising:

activating on the gaming system the second halo when there is the second winning combination of symbols;

displaying on the display system the second halo as a regular image;

resizing the displayed second halo, first halo, and plurality of symbol reels so that the second halo, first halo, and plurality of symbol reels fit within the perimeter of the virtual game board;

rotating the second halo around the first halo on a path that follows the second visual contour;

stopping the second halo rotation; and evaluating the stopped second halo, first halo, and plurality of symbol reels for a third winning combination of symbols.

12. The method of claim 11, further comprising:

a) displaying on the display system as a third phantom image at least a portion of a third halo around the resized display of the second halo, the first halo, and the plurality of symbol reels, the third halo comprising a fourth plurality of symbols that surround at least a portion of the second halo;

b) activating on the gaming system the third halo when there is a third winning combination of symbols, the third halo comprising a fourth plurality of symbols that surround at least a portion of the second halo;

c) displaying on the display system the third halo as a regular image;

d) resizing the displayed third halo, second halo, first halo, and plurality of symbol reels so that the additional halo, second halo, first halo, and plurality of symbol reels fit within the perimeter of the virtual game board;

e) rotating the third halo around the second halo;

f) stopping the third halo rotation;

g) evaluating the stopped third halo, second halo, first halo, and plurality of symbol reels for a fourth winning combination of symbols; and h) repeating a) through g) so long as there is a fourth winning combination of symbols.

13. The method of claim 1 wherein the gaming system comprises a land based gaming cabinet.

14. A gaming system that uses an expanding halo, the gaming system comprising:

a display system that presents a plurality of symbol reels, each of the plurality of symbol reels comprising a first plurality of symbols;

an input system operable to receive both a monetary value input and a reel spinning sequence initiating input, wherein the input system comprises one or more selected from the group consisting of a handle, a button, a coin slot, and a card reader;

a memory storing one or more gaming operations;

a processing system operatively associated with said display system and said input system, said processing system comprising one or more processing units configured to perform one or more expanding halo reels game operations operating said display system and said input system to:

receive at the monetary value input a wager from the input system;

display on the display system spinning one or more of the plurality of symbol reels comprising a first visual contour on a virtual game board, each of the plurality of symbol reels comprising a first plurality of symbols;

stop the spinning one or more of the plurality of symbol reels;

evaluate one or more of the plurality of symbol reels for a first winning combination of symbols;

activate on the gaming system a first halo when there is the first winning combination of symbols, the first halo comprising a second plurality of symbols that surround at least a portion of the plurality of symbol reels;

rotate the first halo around the plurality of symbol reels in a first clockwise or counterclokwise direction on a path that follows the first visual contour;

stop the first halo rotation;

evaluate the stopped first halo and the plurality of symbol reels for a second winning combination of symbols; and terminate game play when there is no second winning combination of symbols.

15. The gaming system of claim 14, wherein said display system comprises a video touchscreen.

16. The gaming system of claim 14, further comprising a communications module operatively associated with said processing system to allow said gaming system to communicate with a network via one or more communications technologies selected from the group consisting of Ethernet, 12C, RD-232, USB, RS-485, IEEE 1394, or Netplex.

17. The gaming system of claim 14, further comprising a land based gaming cabinet.

18. A method for displaying an expanding halo reels game produced by a gaming application operating on a gaming system having a display system, an input system, a memory, and one or more processors to execute instructions stored in the memory, the instructions comprising the gaming application stored in the memory to produce the graphical user interface, the method comprising:

dynamically displaying a virtual game board comprising:

a plurality of reel symbols;

a visual contour defined, at least in part, by the plurality of reel symbols; and a plurality of halo symbols arranged to form at least one halo surrounding and rotating around the plurality of reels symbols during at least one interval of game play on the gaming system:

dynamically displaying the plurality of reel symbols spinning after receiving a wager at the input system;

dynamically displaying the plurality of reel symbols stopped after a first time interval;

dynamically displaying winning indicia after evaluating the stopped plurality of reel symbols for a first winning combination of symbols;

dynamically displaying at least one active halo when there is the first winning combination symbols;

dynamically displaying the plurality of halo symbols associated with the active halo rotating around the plurality of reel symbols on a path that follows the visual contour;

dynamically displaying the plurality of halo symbols stopping after a second time interval; and dynamically displaying winning indicia after evaluating the stopped plurality of halo symbols and stopped plurality of reel symbols for a second winning combination of symbols.

19. The gaming system of claim 18, further comprising a land based gaming cabinet.

* * * * *